US008758080B1

(12) United States Patent
Kerzic

(10) Patent No.: US 8,758,080 B1
(45) Date of Patent: Jun. 24, 2014

(54) TOY HAVING THREE SLIDING HANDLES ON A LOOPED STRING

(76) Inventor: William Louis Kerzic, Santa Monica, CA (US)

( * ) Notice: Subject to any disclaimer, the term of this patent is extended or adjusted under 35 U.S.C. 154(b) by 445 days.

(21) Appl. No.: 13/065,967

(22) Filed: Apr. 4, 2011

Related U.S. Application Data

(60) Provisional application No. 61/341,664, filed on Apr. 3, 2010, provisional application No. 61/343,863, filed on May 5, 2010.

(51) Int. Cl.
*A63H 33/00* (2006.01)

(52) U.S. Cl.
USPC ..... 446/490; 446/242; 446/247

(58) Field of Classification Search
USPC ..... 446/15, 119, 126, 236, 486, 487, 450, 446/490, 491, 242, 247
See application file for complete search history.

(56) References Cited

U.S. PATENT DOCUMENTS 4,889,336 A * 12/1989 Schneiderman ..... 482/125
4,927,402 A * 5/1990 Fables et al. ..... 446/487
5,722,125 A * 3/1998 Vasilopoulos ..... 24/301
5,852,988 A * 12/1998 Gish ..... 119/795
6,273,029 B1 * 8/2001 Gish ..... 119/792
7,137,863 B2 * 11/2006 Hiebert ..... 446/490
7,833,140 B2 * 11/2010 Ligrano et al. ..... 482/124
2005/0048872 A1 * 3/2005 Shaw ..... 446/490

* cited by examiner

*Primary Examiner* — Mini Legesse
(74) *Attorney, Agent, or Firm* — Integral Patent

(57) ABSTRACT

A toy having a looped string and three handles, each of the handles having a grip section, an eyelet through which the string passes, and a swivel between the eyelet and the grip section. The swivels allow the eyelets to rotate relative to the grip sections so that a handle can be held at the grip section and one or both of the other handles can be rotated without resulting in tangling of the string about the eyelet of the held handle. The grip sections are considerably larger and more massive than the eyelets so that the centers of mass of the handles are generally displaced from the string. In an alternate embodiment a pivot is included between each grip section and associated eyelet. A wide variety of motions and maneuvers can be performed by swinging one or more of the handles while holding or releasing one or more of the handles and/or holding or releasing one or more sections of the string. Another alternate embodiment is a triangular sheet of fabric with handles rotatably attached at each corner by swivels.

14 Claims, 16 Drawing Sheets

TOY HAVING THREE SLIDING HANDLES ON A LOOPED STRING

RELATED APPLICATIONS

The present application is based on and claims the priority of provisional patent application Ser. No. 61/341,664 filed Apr. 3, 2010 by the same inventor and having the same title, and the priority of provisional patent application Ser. No. 61/343,863 filed May 5, 2010 by the same inventor and having the same title.

FIELD OF THE INVENTION

The present invention is related to toys, particularly skill toys, more particularly skill toys which include a string or rope or sheet of fabric, and still more particularly to skill toys which include a string or rope and masses affixed to or slideable along or in some other way tethered to the string or rope or sheet of fabric.

BACKGROUND OF THE INVENTION

A number of toys include a string or rope, including the yo-yo, the lasso, and sliding bob toys such as those described in U.S. Pat. No. RE34,208 and U.S. Pat. No. 7,137,863. The toy described in U.S. Pat. No. RE34,208 has three centrally-bored bobs on a string, with the string passing through the bores in the bobs and the bobs being constrained to the string. The toy described in U.S. Pat. No. 7,137,863 has two centrally-bored bobs on a string, with the string passing through the bores in the bobs and the bobs being constrained to the string. Furthermore, a new category of yo-yo play called "5A" has arisen where a mass is attached at the end of the string opposite the rotateable slotted disc.

For each of the above-mentioned toys, different types of motions and maneuvers are possible due to their differing geometries. As is apparent from the many videos of these toys posted on the Internet, these simple geometries allow an incredibly wide variety of motions and maneuvers to be performed. Furthermore, simple differences in the geometries allow considerably different types of motions and maneuvers to be performed, while often also providing some overlap in the motions and maneuvers that can be performed.

It is therefore an object of the present invention to provide a skill toy having a string or rope or sheet of fabric and handles affixed to, tethered to or slideable along the string or rope.

It is another object of the present invention to provide a skill toy allowing new types of motions and maneuvers to be performed.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE INVENTION

The present invention is directed to a toy having three handles on a looped string. Each of the handles has an eyelet through which the string passes, a grip section which is substantially larger and more massive than the eyelet and offset from the eyelet, and a swivel connecting the eyelet to the grip section and allowing the grip section to swivel relative to the eyelet.

The present invention is also directed to a toy having three handles on a sheet of fabric. Each of the handles has a grip section and a swivel connecting the grip section to the fabric and allowing the grip section to swivel relative to the fabric.

BRIEF DESCRIPTION OF THE DRAWINGS

The accompanying figures, which are incorporated in and form a part of the present specification, illustrate embodiments of the invention and, together with the description given above and the detailed description of the preferred embodiments given below, serve to explain the principles of the invention.

In the figures, dotted arrows are used to show the motion described by hands and bobs. Dotted hands and dotted bobs are used to show future positions of the hands and bobs. A double arrow converging indicates motion into the page, and a double arrow diverging indicates motion out of the page. A double arrow on an orbital path is the portion of that path which is relatively out of the page, and a single arrow on an orbital path is the portion of that path which is relatively into the page.

DETAILED DESCRIPTION OF THE PREFERRED EMBODIMENT

Figure 1:
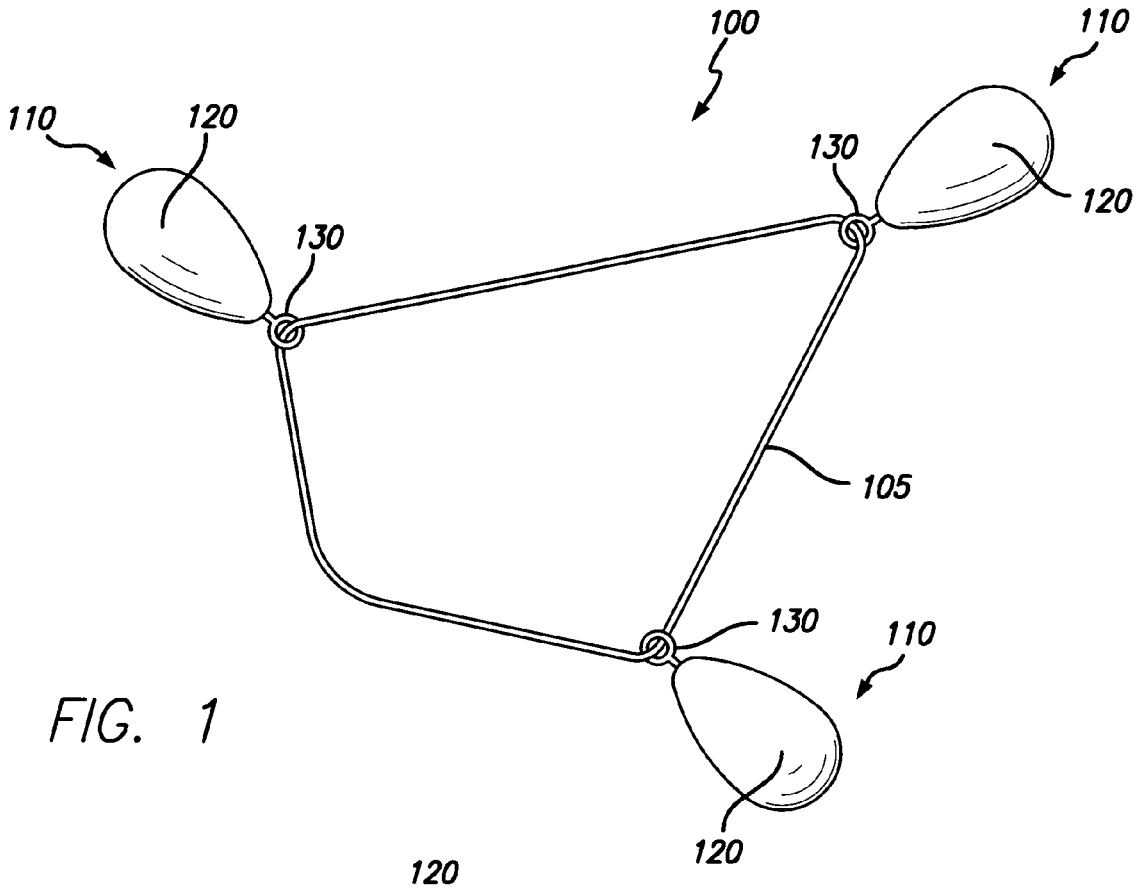
FIG. 1 shows a perspective view of the toy of the present invention.
Figure 2A:
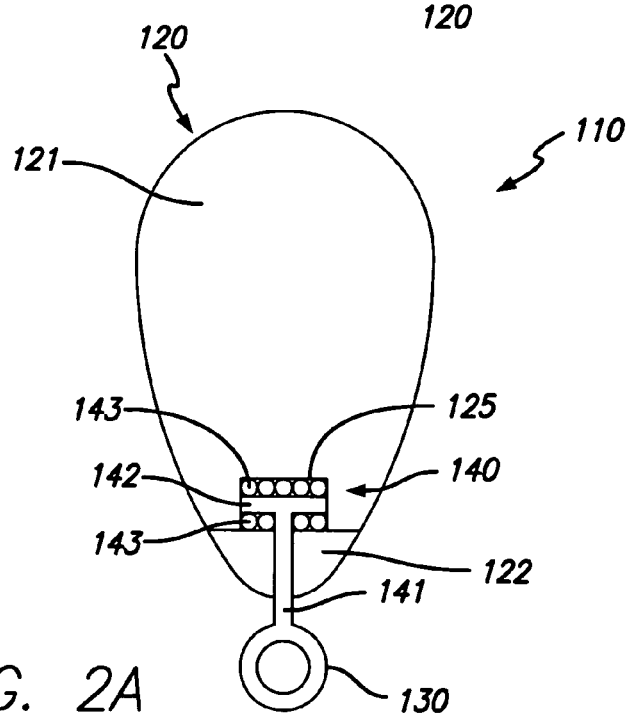
FIG. 2A shows a cross-sectional view of a first embodiment of the handle of the toy of the present invention.

The toy of the present invention is shown in FIG. 1. The toy 100 consists of a looped string 105, i.e., a string which forms a loop, and three handles 110. Each of the handles 110 has a grip section 120, which is large enough to be easily grasped and held, and an eyelet 130 through which the string 105 passes. The grip sections 120 are substantially larger and more massive than the eyelets 130. In the preferred embodiment the grip sections have a width of about 5 cm. As will be understood better when play with the toy 100 is described below, because the grip sections 120 are considerably more massive than the eyelets 130, the center of mass of each handle 110 is generally displaced from the string. As shown in FIG. 2A but not visible in FIG. 1, connecting each eyelet 130 to its associated grip section 120 is a low-friction swivel 140. The eyelets 130 have a diameter which is only slightly larger than the diameter of the string 105 so that twisting of the string 105 about an eyelet 130 will produce a torque large enough to induce the eyelet 130 to rotate. Preferably, the diameter of the eyelets 130 is one and a quarter (1.25) to ten (10) times the diameter of the string 105, more preferably the diameter of the eyelets 130 is two (2) to seven (7) times the diameter of the string 105, more preferably the diameter of the eyelets 130 is two and a half (2.5) to five (5) times the diameter of the string 105, and most preferably the diameter of the eyelets 130 is three (3) to four (4) times the diameter of the string 105. (In the present specification, "substantially" larger, "considerably" larger or the like is intended to mean at least an order of magnitude difference, i.e., at least a factor of ten.) Because the eyelets 130 do not have openings, the toy 100 is assembled by passing a non-looped string through the eyelets and then sewing the ends of the string together to create an essentially seamless connection.

As can be seen in the cross-sectional view of FIG. 2A, the eyelet 130 is connected via a connecting arm 141 to a ball bearing which serves as the swivel mechanism 140. At the end of the connecting arm 141 opposite the eyelet 130 is a disc-shaped flange 142, and the flange 142 is seated in a cavity 125 in the grip section 120 which forms a housing for the balls 143 and flange 142 of the ball bearing. The grip section 120 has a main body 121 and a two-part cap 122. The swivel mechanism 140 is assembled by inserting the balls 143 and flange 142 into the cavity 125 of the main body 121 and then sealing the cavity 125 with the cap 122.

Figure 2B:
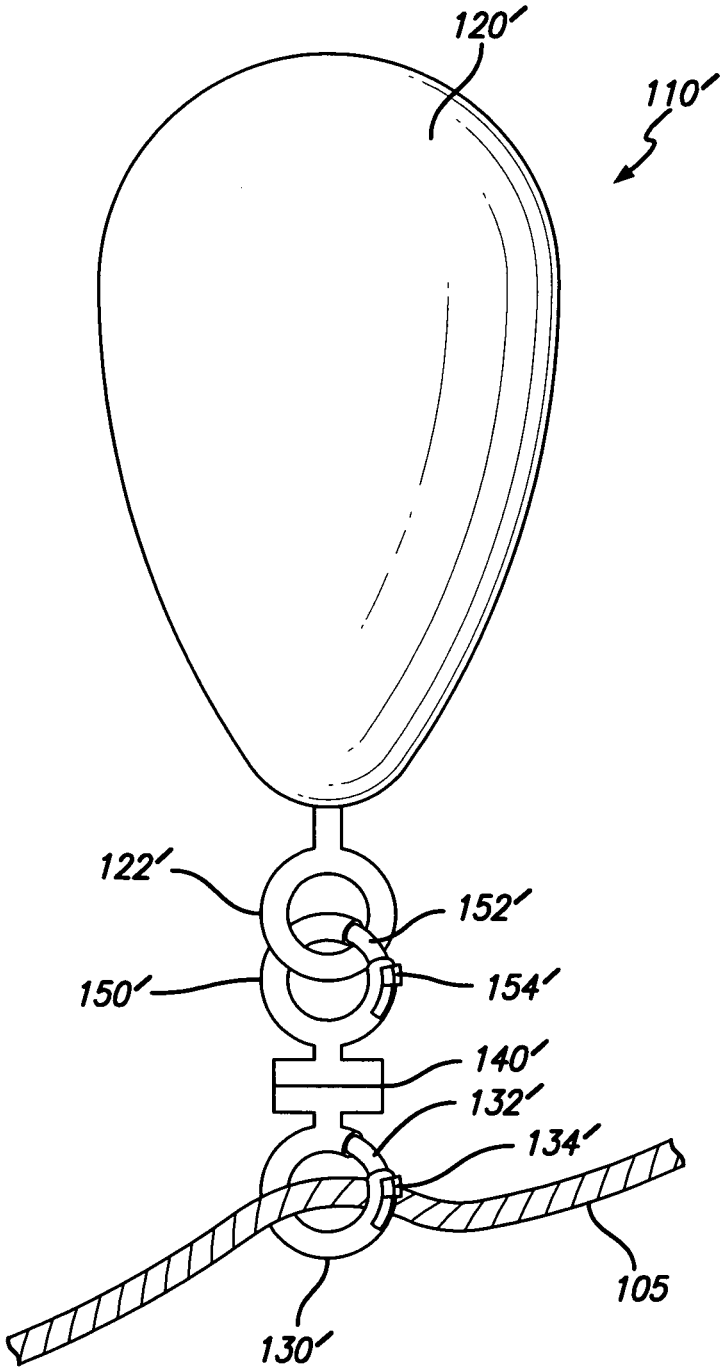
FIG. 2B shows a cross-sectional view of a second embodiment of the handle of the toy of the present invention.

An alternate preferred embodiment of the handle 110' is shown in FIG. 2B. In this embodiment, the grip section 120' has a first ring-shaped eyelet 122' extending from it. Linked to the first eyelet 122' is a second ring-shaped eyelet 150', and a third ring-shaped eyelet 130' is connected to the second eyelet 150' via a swivel mechanism 140' which allows the third eyelet 130' to swivel relative to the second eyelet 150', i.e., the axis of cylindrical symmetry of the third eyelet 130' can rotate relative to the axis of cylindrical symmetry of the second eyelet 150' in a plane orthogonal to the axis between the second and third eyelets 150' and 130'. Both the second and third eyelets 150' and 130' have retractable sections 152' and 132' which may be retracted to create an opening in the eyelets 150' and 130' by drawing back a spring-loaded lever 154' and 134', respectively. This type of eyelet with a retractable section is well known in the art of jewelry for use in necklaces and bracelets. The retractable section 132' in the eyelet 130' in contact with the looped string 105 provides the advantage that the looped string 105 may be replaced with another looped string if it 105 becomes worn or breaks. The retractable section 152' in the eyelet 150' in contact with the eyelet 122' extending from the grip section 120' provides the advantage that the swivel mechanism 140' may be replaced if it becomes worn or breaks. It should also be noted that this construction provides a pivot, i.e., it allows for the pivoting of the third eyelet 130' about the first eyelet 122'. More particularly, the swivel mechanism 140' allows the third eyelet 130' to rotate about its center so that the axis of cylindrical symmetry rotates about the axis between the second and third eyelets 150' and 130'. In contrast, the pivoting provided by this construction allows the angle between the grip section 120' and the axis connecting the second and third eyelets 150' and 130' to vary. The extra degrees of freedom in the connection between the grip section 120' and the string-contacting third eyelet 130' provided by the pivoting further reduces the likelihood of the string 105 tangling about the third eyelet 130'.

Figure 2C:
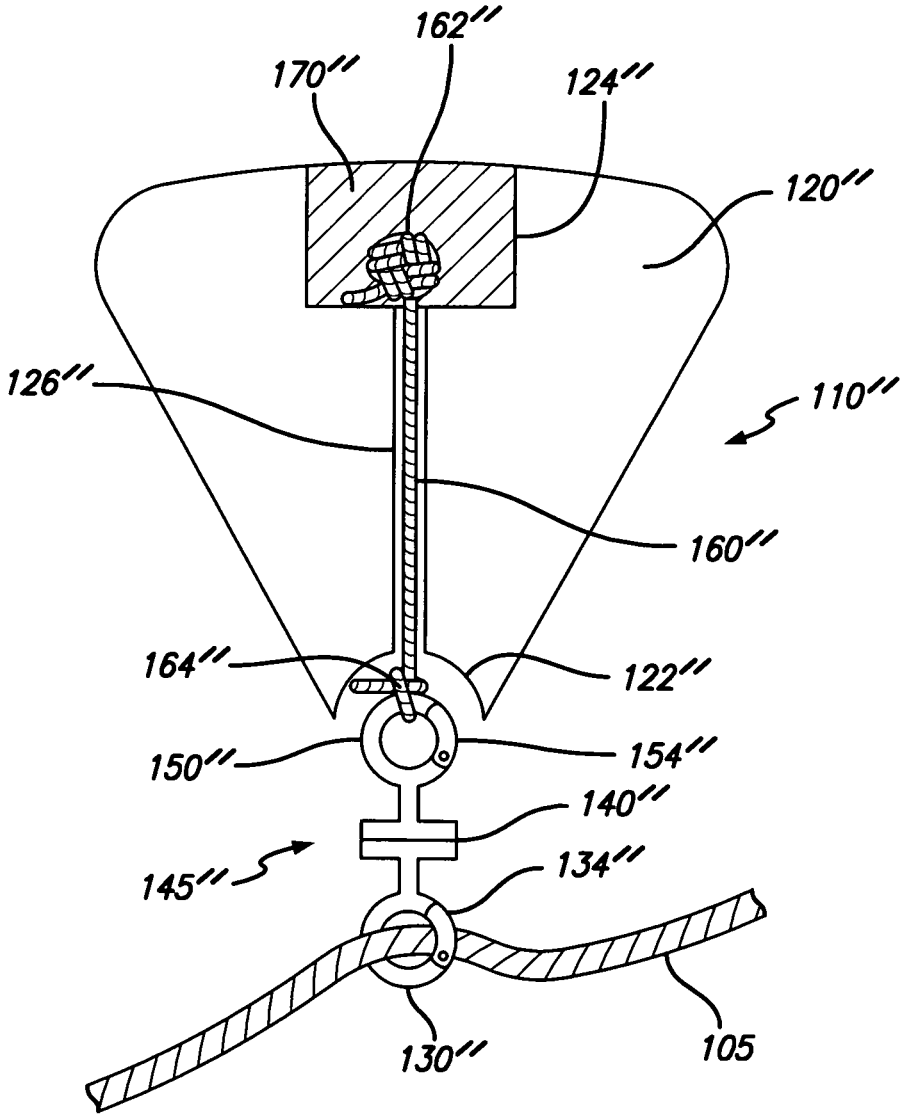
FIG. 2C shows a cross-sectional view of a third embodiment of the handle of the toy of the present invention.

Another alternate preferred embodiment of the handle 110" is shown in FIG. 2C. In this embodiment, the grip section 120" has a top cavity 124", a bottom cavity 122", and a through-bore 126". A docking string 160" in the handle 120" has a large upper knot 162" at the top end, passes through the through-bore 126" of the grip section 120", and is knotted at its bottom end in the bottom cavity 122" at a knot 164" to a swivel 145". A casting material 170" fills the top cavity 124", securing the large knot 162" in the top cavity 124". The swivel 145" has a first ring-shaped eyelet 150", and a second ring-shaped eyelet 130" connected to the first eyelet 150" via a swivel mechanism 140" which allows the second eyelet 130" to swivel relative to the first eyelet 150" about the axis between the two eyelets 130" and 150", i.e., the axis of cylindrical symmetry of the second eyelet 130" can rotate relative to the axis of cylindrical symmetry of the first eyelet 150" in a plane orthogonal to the axis between the first and second eyelets 150" and 130". The looped string 105 passes through the second eyelet 130". Both the first and second eyelets 150" and 130" have spring-biased carabiners 154" and 134' which may be pivoted inwards to create an opening in the eyelets 150" and 130", respectively. The carabiner 134" in the eyelet 130" in contact with the looped string 105 provides the advantage that the looped string 105 may be replaced with another looped string if it 105 becomes worn or breaks. The carabiner 154" in the eyelet 150' tied to the docking string 160" provides the advantage that the swivel 145" may be replaced if it becomes worn or breaks. It should be noted that this construction allows the swivel 145" to pivot, i.e., it allows for the pivoting of the axis between the first and second eyelets 150" and 130" away from the longitudinal axis of the through-bore 126" in the grip section 120". The extra degrees of freedom in the connection between the grip section 120" and the string-contacting second eyelet 130" provided by the pivoting further reduces the likelihood of the string 105 tangling about the second eyelet 130".

As is the case with the yo-yo, lasso, and the swinging bob toys described in U.S. Pat. No. RE34,723 and U.S. Pat. No. 7,137,863, the number of possible maneuvers with the toy 100 of the present invention is vast. Of the wide variety of motions and maneuvers possible with the toy 100, only a very small subset are described below. In a first mode of motion shown in FIG. 3, one grip section 120 is held and the two hanging handles 110 are spun in a horizontal circle. The player may alter this mode of motion by grasping and pulling down on the string 105 between the hanging handles 110, causing the distance between the hanging handles 110 to decrease and the speed of the horizontal orbit to increase.

Figure 4A:
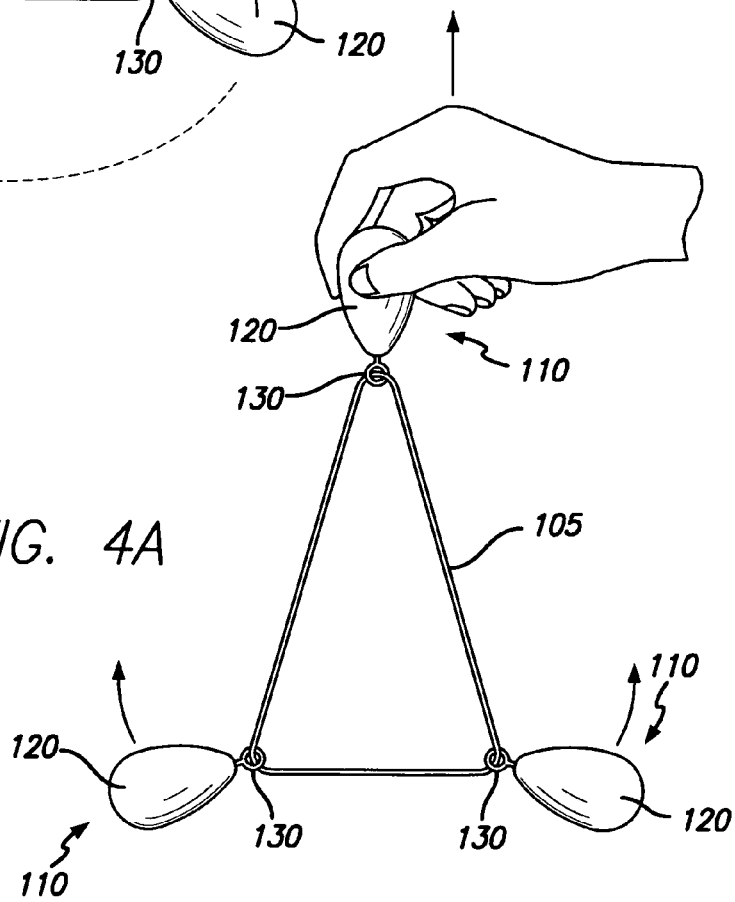
FIGS. 4A-4C show a second mode of motion of the toy of the present invention.
Figure 4B:
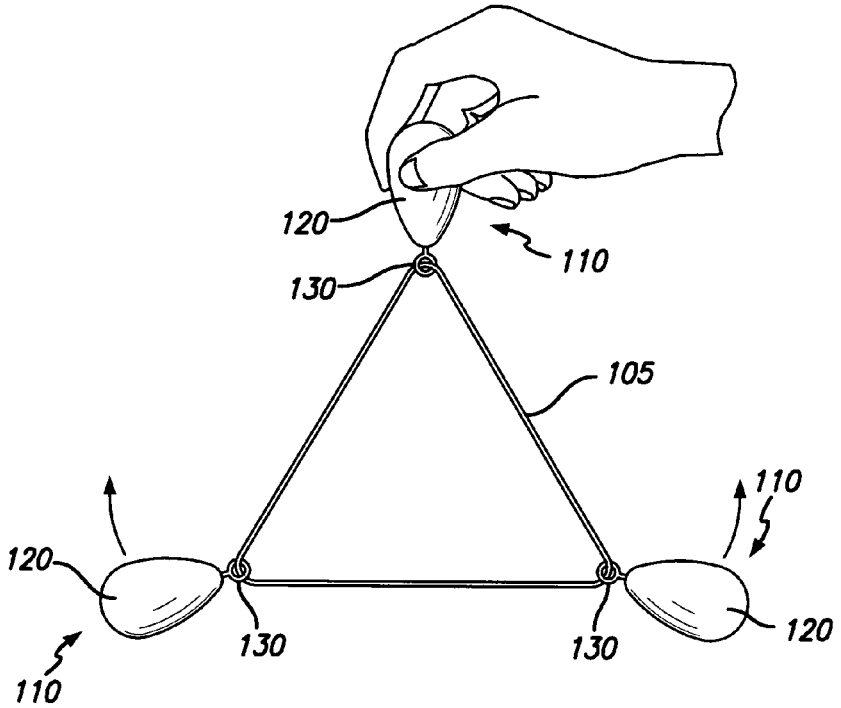
Figure 4C:
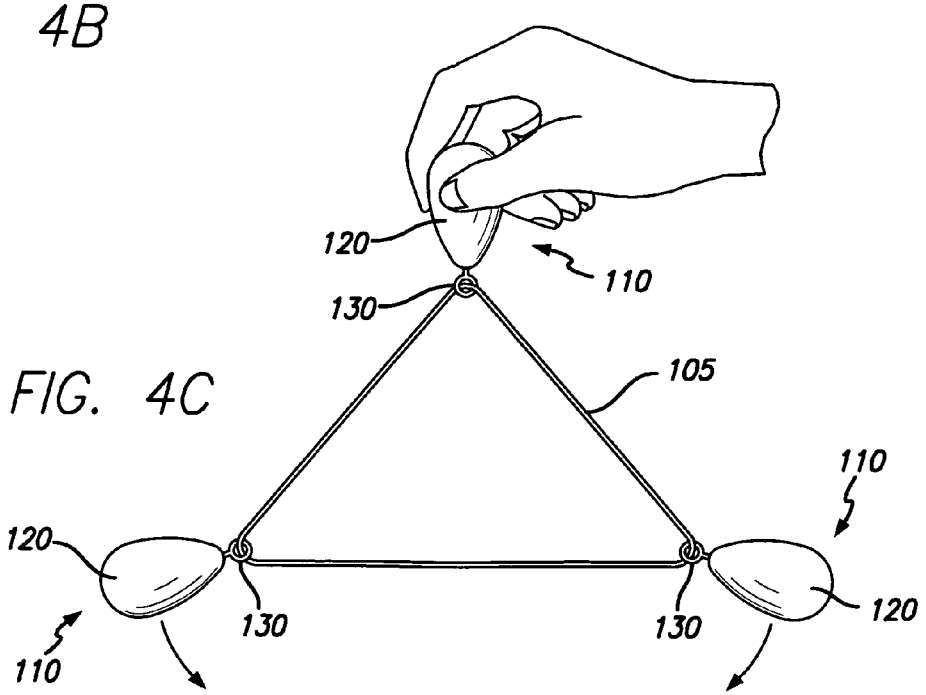

In a second mode of motion shown in FIGS. 4A, 4B and 4C, one grip section 120 is held and the hanging two handles 110 are bounced up and down. FIG. 4A shows the hanging two handles 110 at their lowest point and the arrows near the hanging two handles 110 indicate that they are in motion upwards. FIG. 4B shows the hanging two handles 110 at a midpoint in their vertical motion and the arrows near the hanging two handles 110 indicate that they are still in motion upwards. FIG. 4C shows the hanging two handles 110 at their highest point and the arrows near the hanging two handles 110 indicate that they are now in motion downwards where the configuration will be, sequentially, as shown in FIGS. 4B and 4A, except now with downwards motion of the two hanging handles 110.

Figure 5:
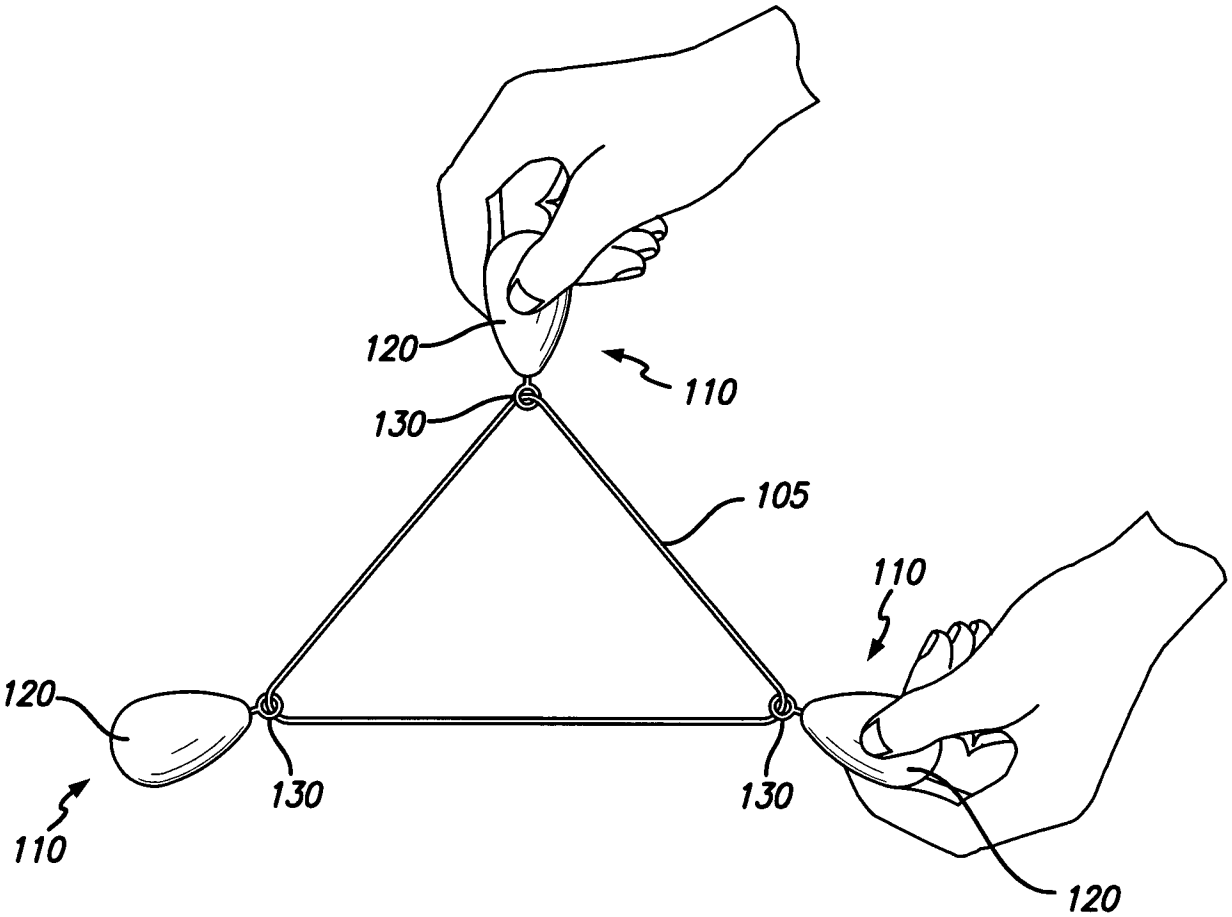
FIG. 5 shows a third mode of motion of the toy of the present invention.

FIG. 5 shows two grip sections 120 being held and the free handle 110 being swung. A number of different maneuvers are possible from this position: the free handle 110 may be made to swing in a circular orbit that passes through the arms; the free handle may be swung over a wrist so that the two sections of string 105 between the free handle 110 and two held handles 110 comes to rest over the wrist, and then the free handle 100 may, for instance, be swung in the reverse direction off the wrist; a held handle 110 may be released and the string 105 or the initially-free handle 110 may be grabbed; the held handles 110 may be pulled apart to accelerate the free handle 110 towards the portion of the string 105 between the held handles 110; etc.

Figure 6A:
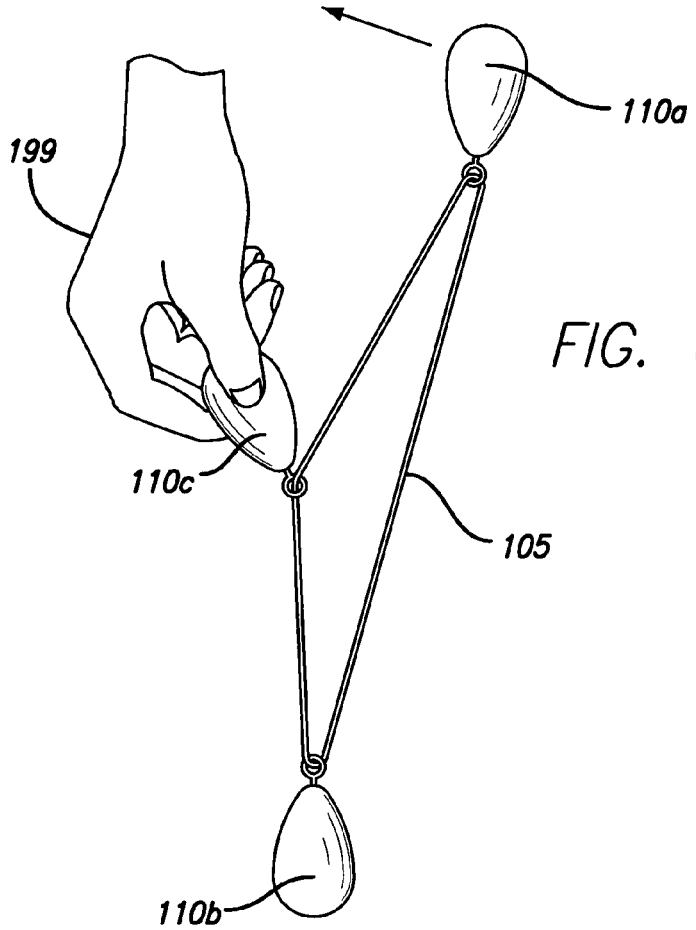
FIGS. 6A-6C show a vertical orbit maneuver performed with the toy of the present invention.
Figure 6B:
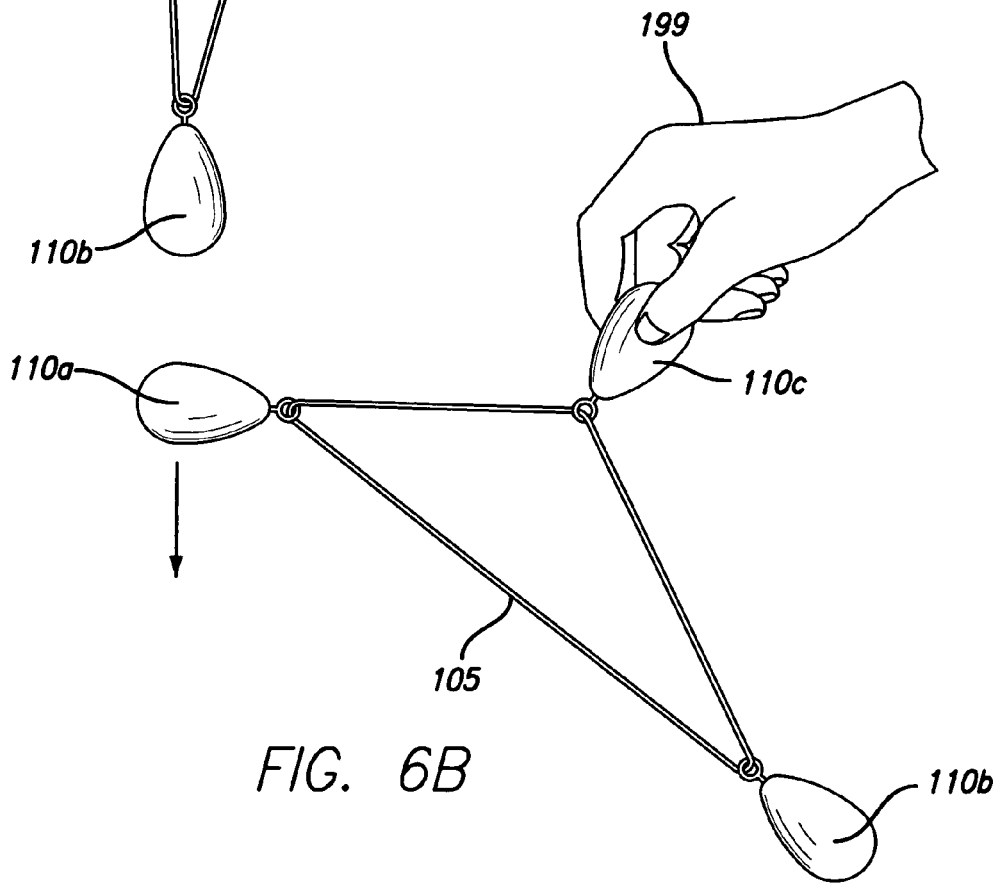
Figure 6C:
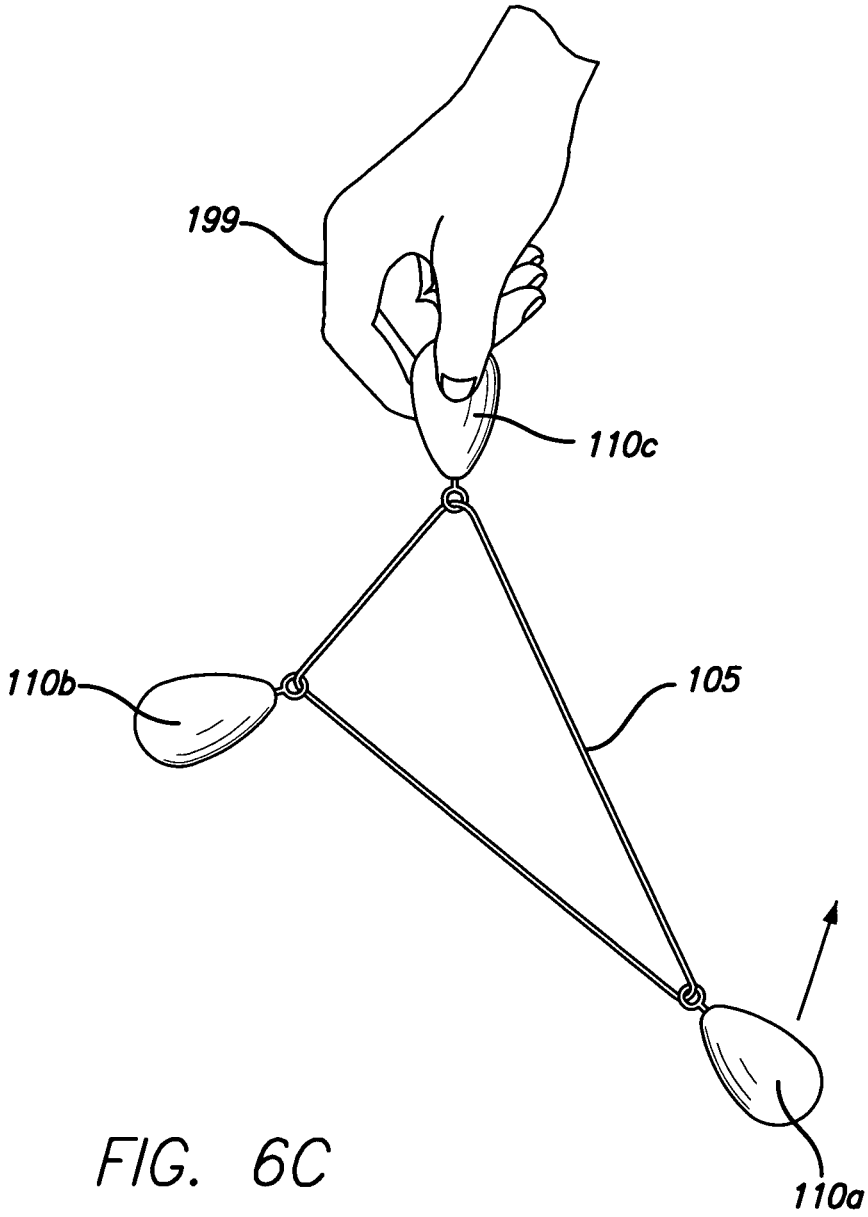

Another maneuver possible with the toy 100 of the present invention is a vertical orbit. One handle 110*c* is held and vertical oscillations of the hand 199 cause one handle 110*a* to move in a large orbit which passes over the hand 199, as is shown in FIG. 6A, and under the other orbiting handle 110*b*, as is shown in FIGS. 6B and 6C. Interestingly, the vertical orbit shown in FIGS. 6A, 6B and 6C is similar to the vertical orbit that can be performed with the toy of U.S. Pat. No. RE34,723, but in the case of the toy 100 of the present invention the handle 110*a* with the larger orbit must pass over the held handle 110*c*, while with the toy of U.S. Pat. No. RE34, 723 the outer swinging bob can pass over or under the held bob during vertical orbits.

Figure 7A:
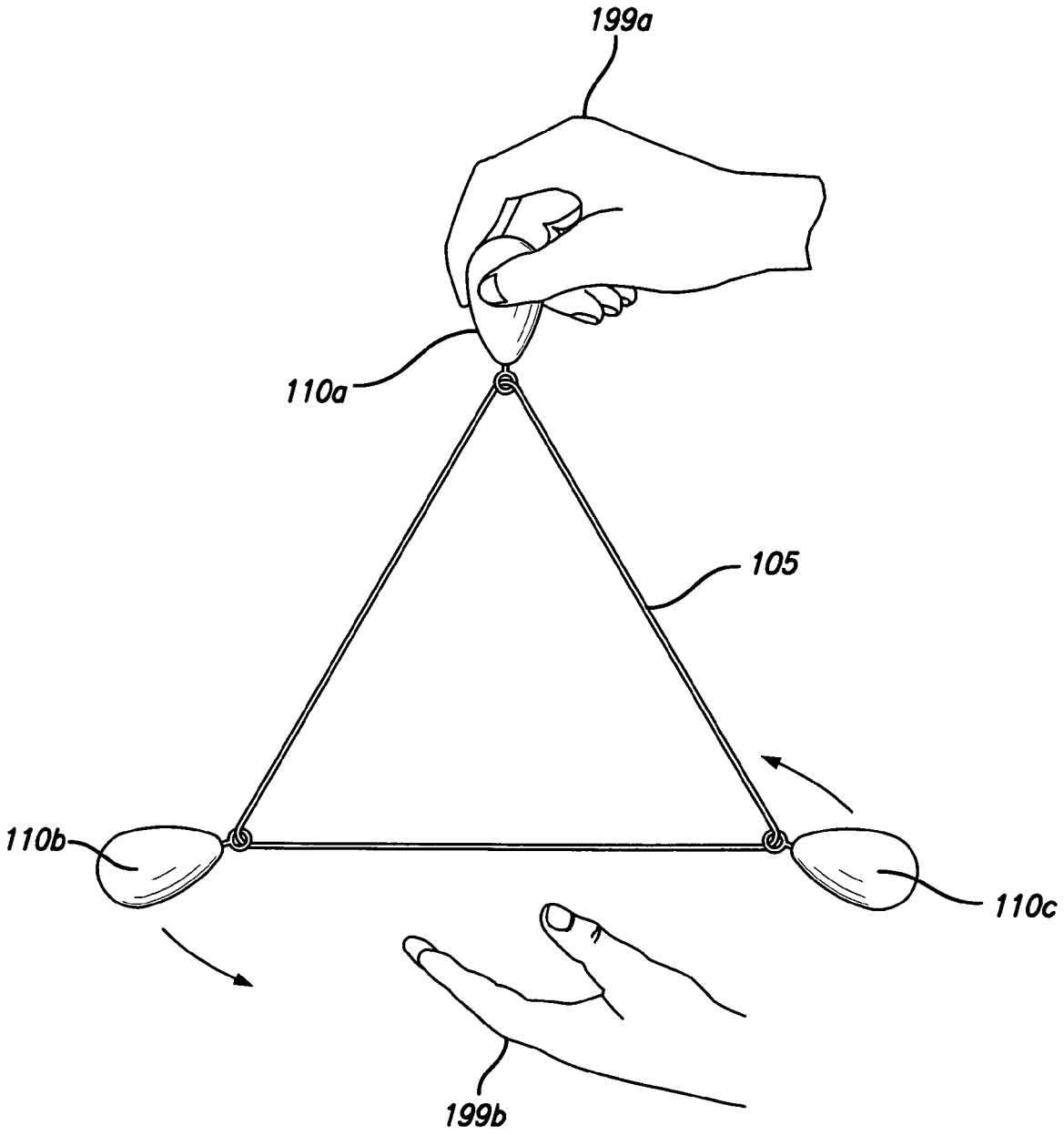
FIGS. 7A-7D show a complex maneuver performed with the toy of the present invention.
Figure 7B:
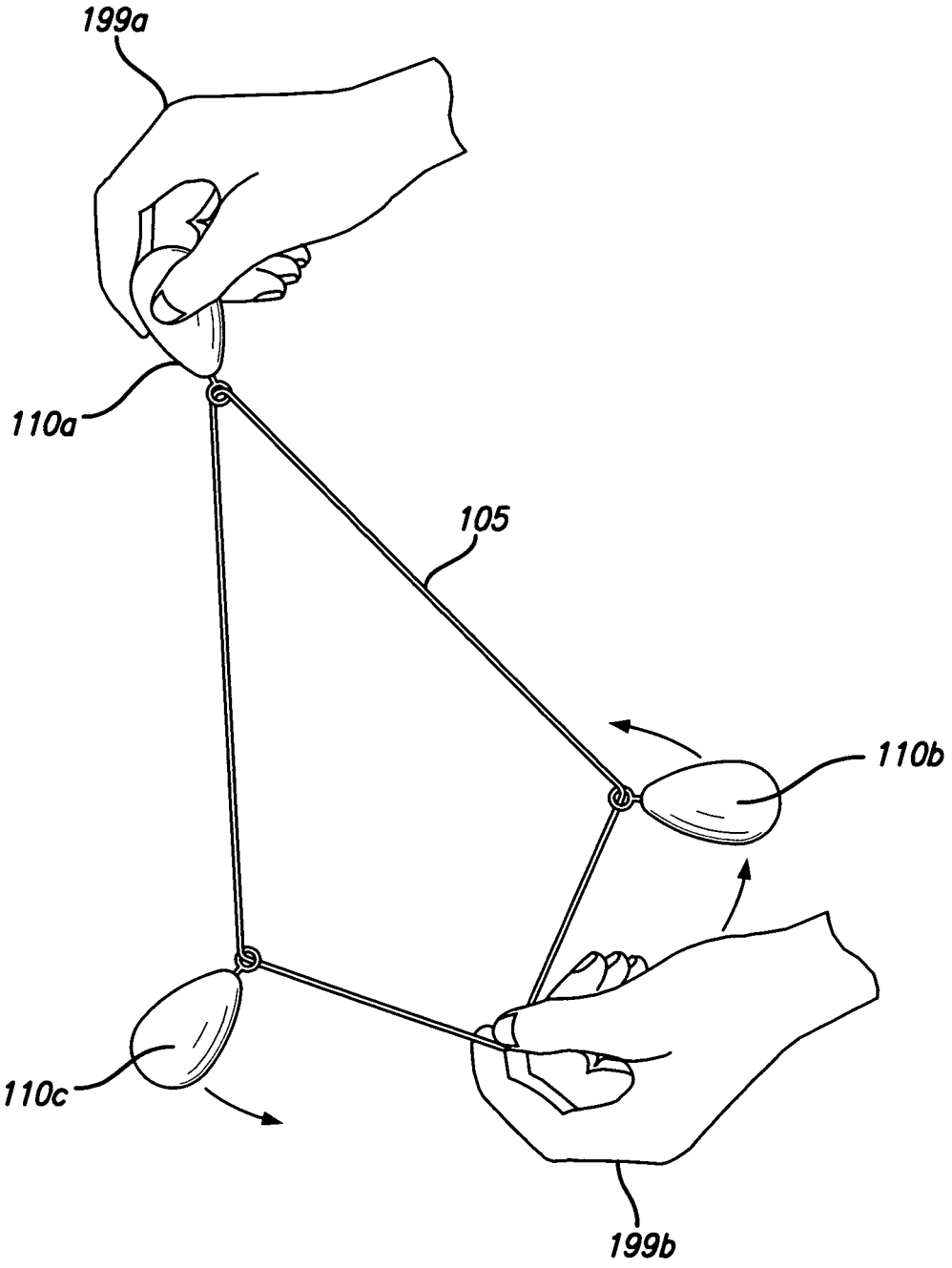
Figure 7C:
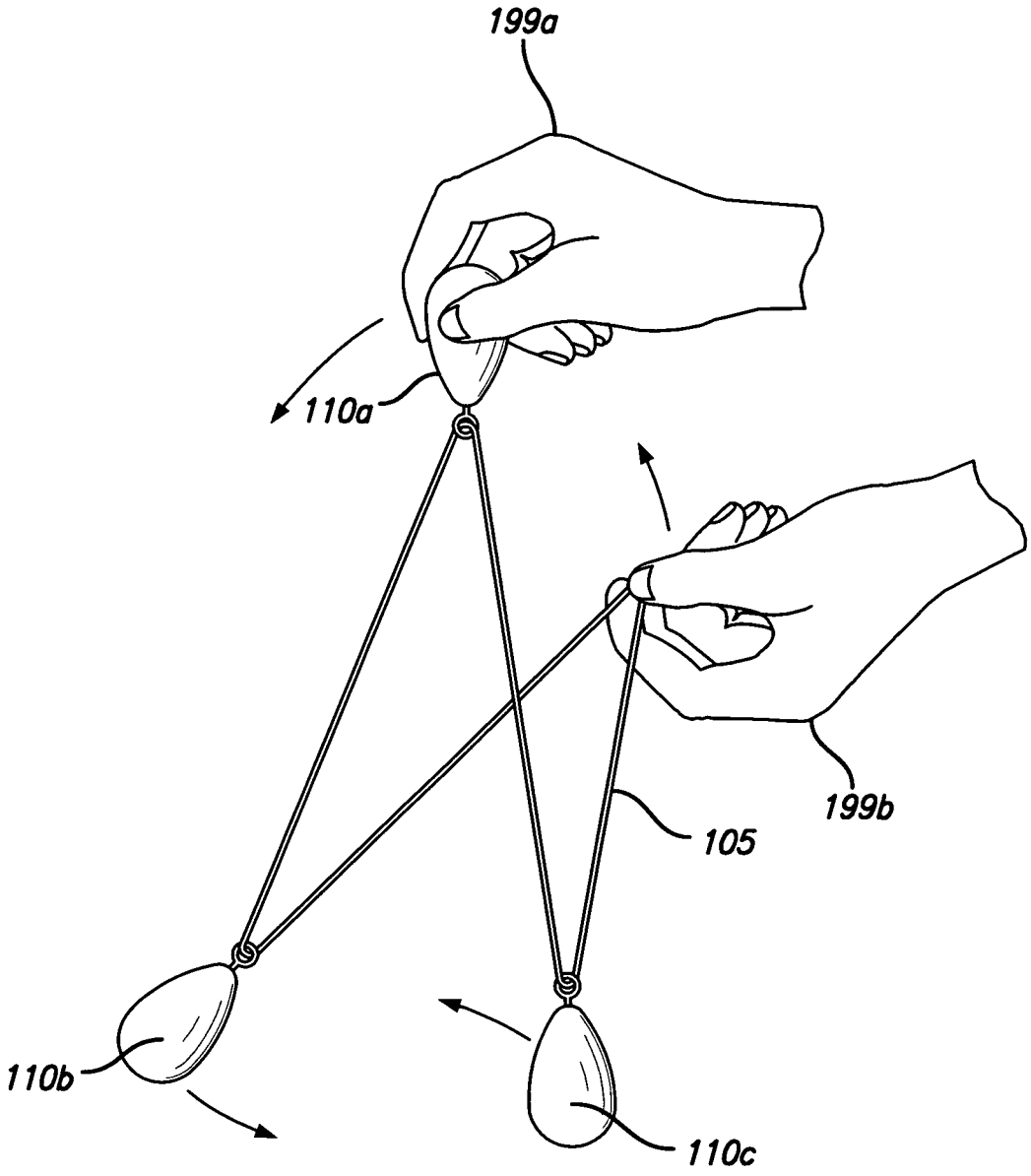
Figure 7D:
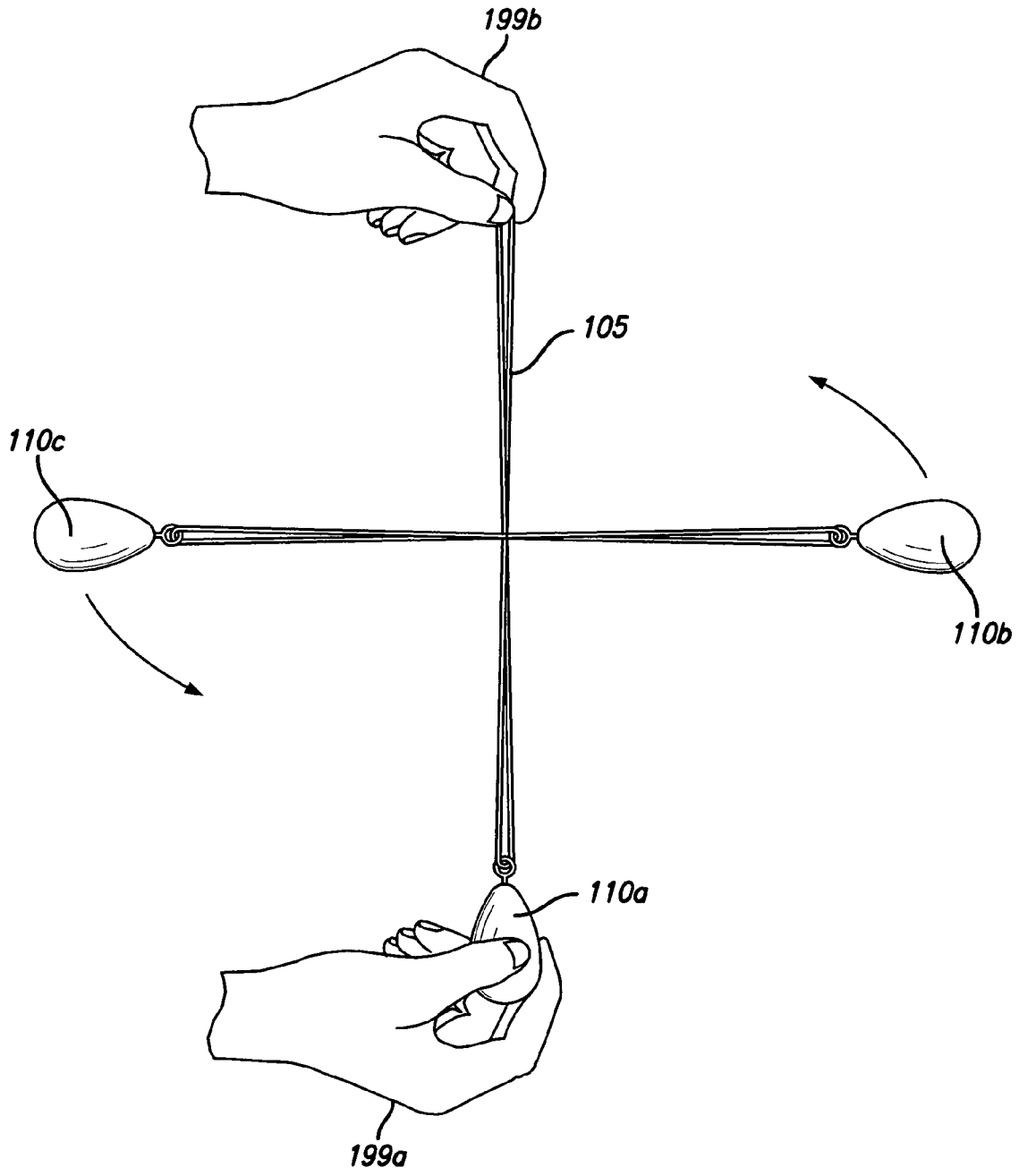

Another maneuver possible with the toy 100 of the present invention is shown in FIGS. 7A, 7B, 7C and 7D. The maneuver begins with one hand 199*a* holding a handle 110*a* and the two hanging handles 110*b* and 110*c* orbiting horizontally, as shown in FIG. 7A. Then, as shown in FIG. 7B, the string 105 between the two horizontally orbiting handles 110*b* and 110*c* is grabbed by the other hand 199*b*, and the hand 199*b* holding the string 105 is raised upwards while the two swinging handles 110*b* and 110*c* continue to orbit, as is shown in FIGS. 7B and 7C, and the hand 199*a* holding the handle 110*a* is lowered causing the string 105 to form a cross while the two swinging handles 110*b* and 110*c* continue to orbit.

Figure 8:
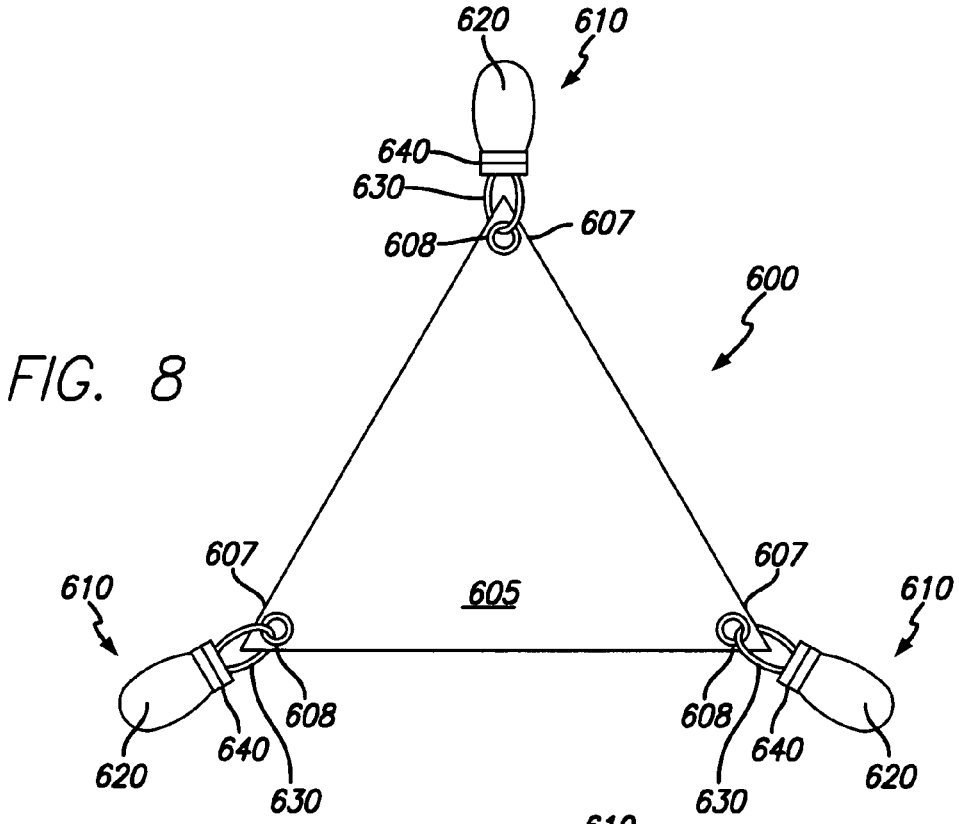
FIG. 8 shows an alternate embodiment of the present invention where three swiveling handles are attached at corners of a triangular sheet of fabric.

An alternate embodiment of the present invention is shown in FIG. 8. The toy 600 consists of a triangular sheet of fabric 605 and three handles 610. The fabric 605 is a thin, substantially planar, flexible material, and may be made of a cloth, flexible plastic, etc. The fabric may or may not have elasticity, i.e., it may or may not be stretchy. At each corner 607 of the fabric 605 is an eyelet 608. Each of the handles 610 has a grip section 620, which is large enough to be easily grasped and held, and a swivel 640 with a connection ring 630 for attaching the grip section 620 to the eyelet 608. The grip sections 620 are substantially larger and more massive than the swivels 640 and eyelets 608, and the centers of mass of the grip sections 620 are displaced from the swivels 630 and eyelets 608. Preferably, the combined masses of the handles 610 is greater than that of the sheet of fabric 605, and more preferably the mass of each handle 610 is greater than the mass of the sheet of fabric 605. In the preferred embodiment the grip sections have a width of about 5 cm. Twisting of the fabric 605 relative to a grip section 620 will produce a torque large enough to induce the swivel 640 to rotate.

Figure 3:
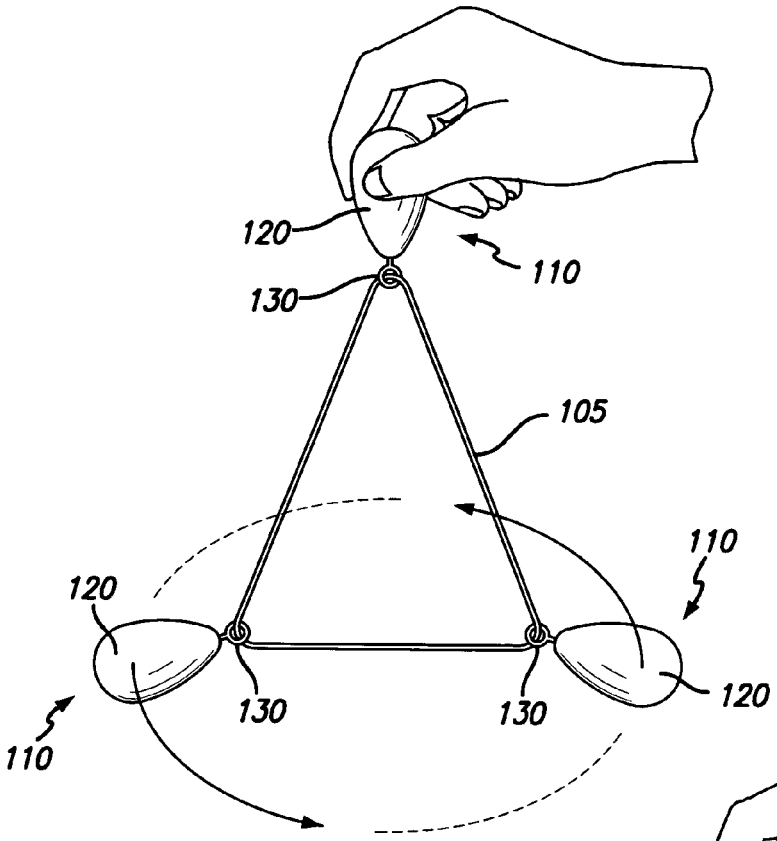
FIG. 3 shows a first mode of motion of the toy of the present invention.
Figure 9:
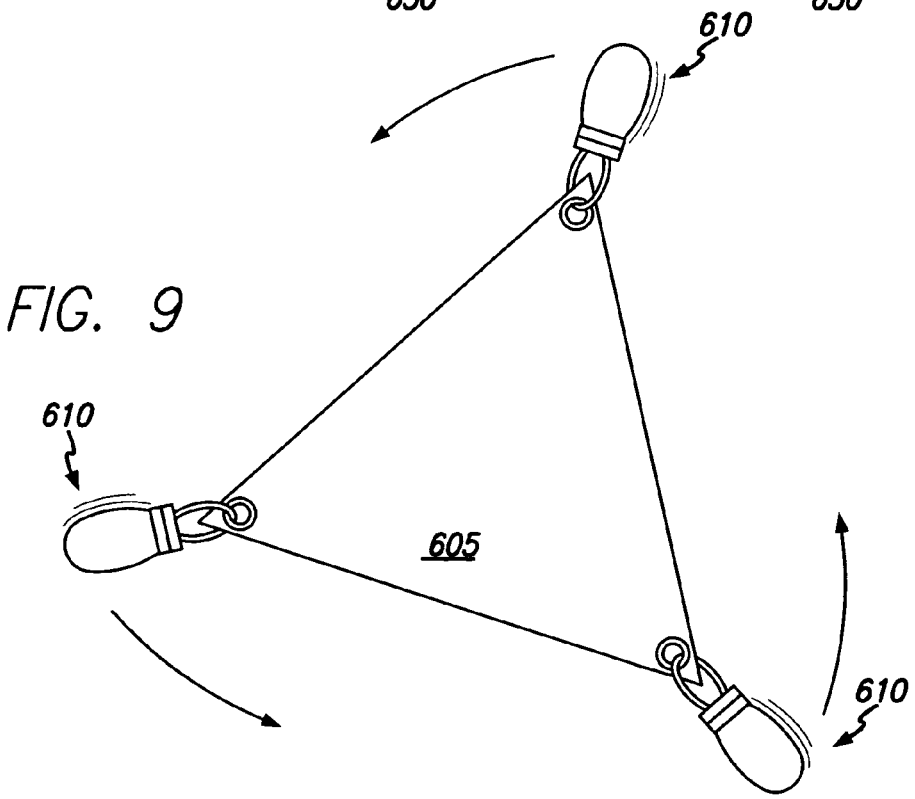
FIG. 9 shows the alternate embodiment of toy of the present invention while airborne and spinning.
Figure 10:
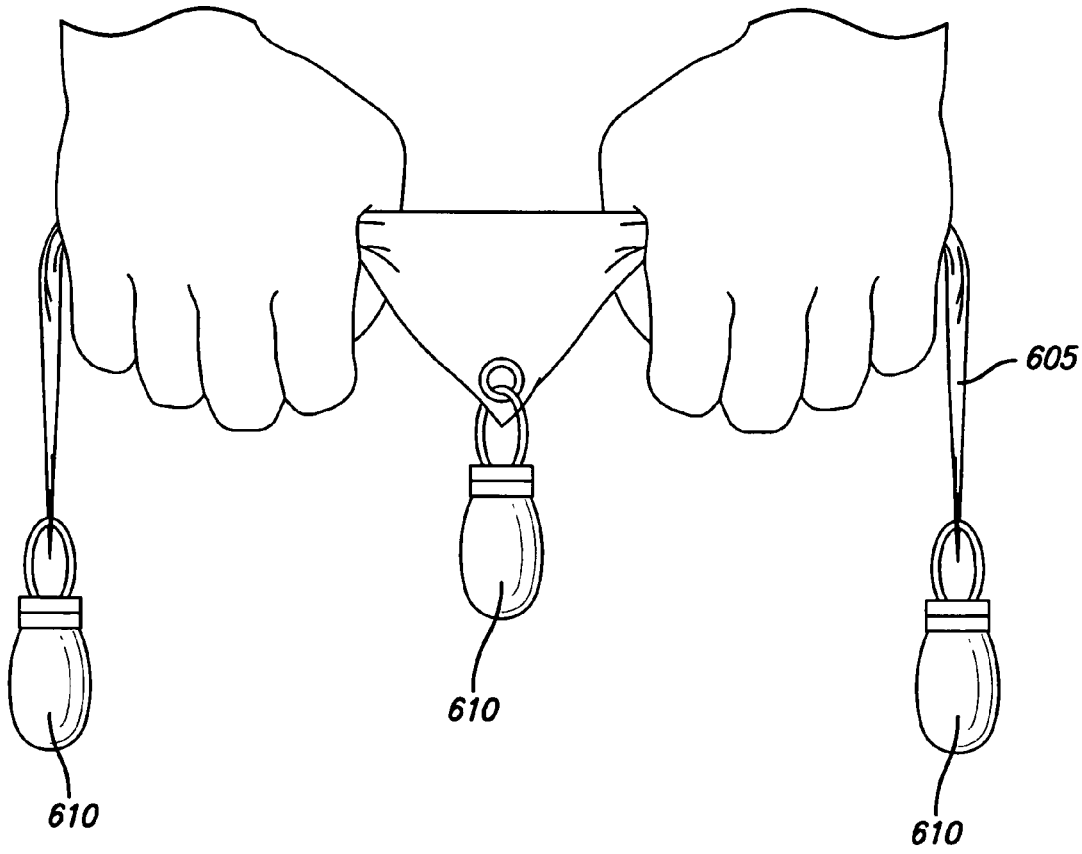
FIG. 10 shows the alternate embodiment of toy of the present invention held in a manner that allows poi-type moves to be performed.
Figure 11A:
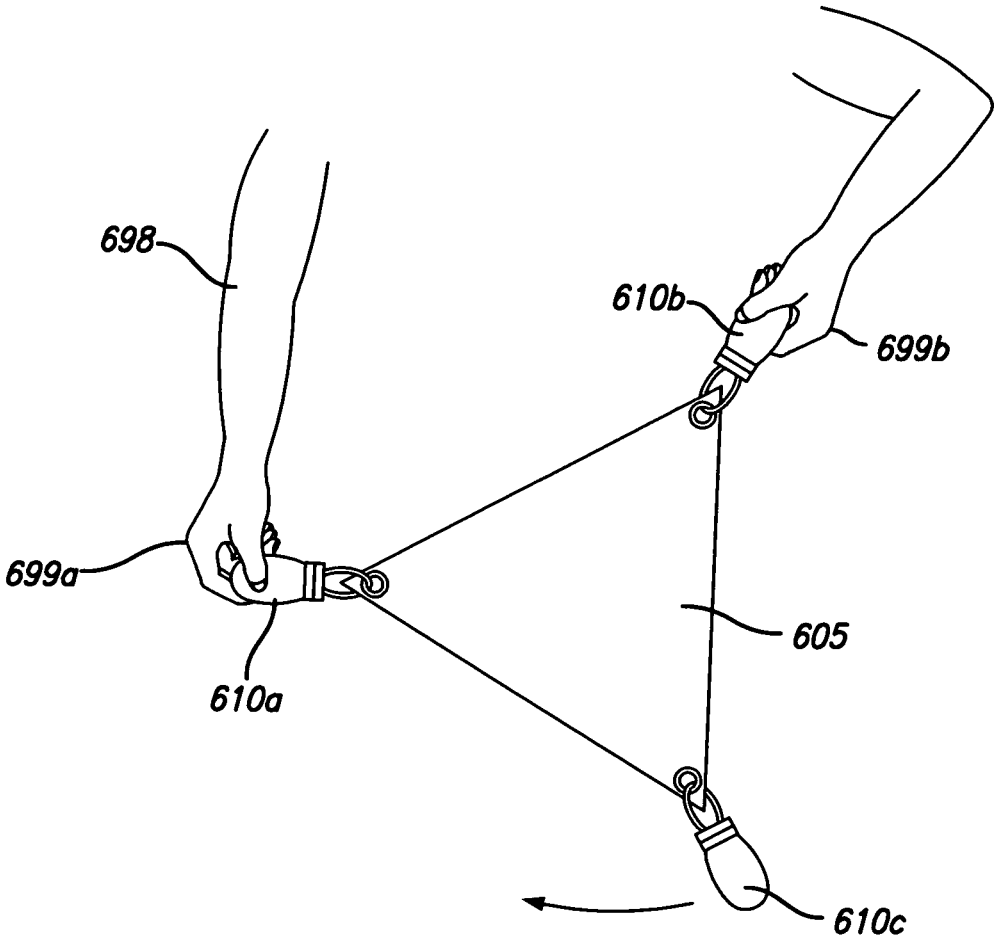
FIGS. 11A-11C show a maneuver where a handle is bounced off the fabric of the alternate embodiment of toy of the present invention.
Figure 11B:
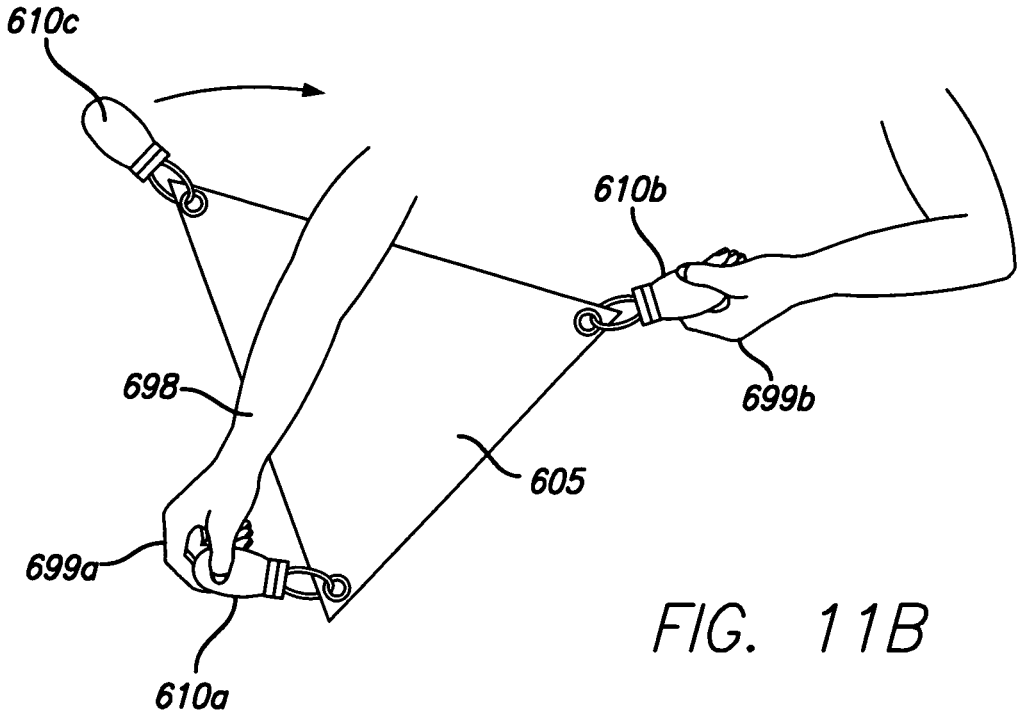
Figure 11C:
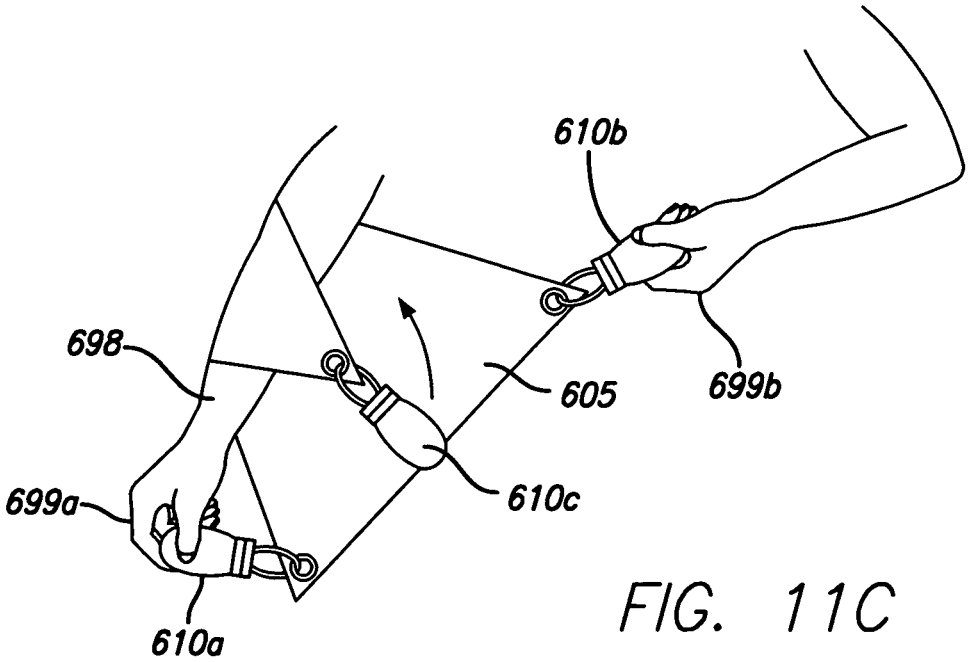

The toy 600 of FIG. 8 allows those modes of play provided by the toy 100 of FIG. 1 where the handles 110 do not slide along the string 105, such as the mode of play depicted in FIG. 3 (but does generally not allow modes of play provided by the toy 100 of FIG. 1 where the handles 110 do slide along the string 105). In addition, the sheet of fabric 605 has aerodynamic properties that allow new maneuvers. For instance, two handles 610 may be held and the toy 600 may be flung into the air—the handles 610 will rotate and separate as shown in FIG. 9 and the fabric 605 will act as a parachute to reduce the falling speed. Or the toy 600 may be flung in the air and the center of the fabric 605 poked upwards to perform a series of bounces, similar to a manipulation commonly seen with pizza dough. Also, one handle 610 may be held and vertical rotations of the hand can produce vertical orbits of the two free handles 610. Or by holding the toy 600 as shown in FIG. 10, poi-type maneuvers may be performed with the two outside handles 610. Also, a number of maneuvers where a handle 610 is bounced off the fabric 605 can be performed. For instance, a handle 610*a* and 610*b* can be held in each hand 699*a* and 699*b*, as shown in FIG. 11A, and the free handle 610*c* can be swung under and around an arm 698 and bounced off the fabric 605, as shown in FIGS. 11B and 11C.

Thus, it will be seen that the improvements presented herein are consistent with the objects of the invention for a toy described above. While the above description contains many specificities, these should not be construed as limitations on the scope of the invention, but rather as exemplifications of preferred embodiments thereof. Many other variations are within the scope of the present invention. For example: the string is more generally a flexible tethering means, and may be made of yarn, rope, etc.; more than three handles may be mounted on the string; the swivel mechanisms may not include ball bearings and may take other forms; the sheet of fabric may be a regular or irregular polygon having more than three sides; the handles may be located at subset of the corners of the sheet of fabric; one or more handles may be located away from corners of the sheet of fabric; the fabric may not have corners, and may for instance be circular; and so on. Accordingly, it is intended that the scope of the invention is determined not by the embodiments illustrated or the physical analyses motivating the illustrated embodiments, but rather by the claims to be appended to the non-provisional patent application based on this provisional patent application and their legal equivalents.

What is claimed is:

1. A toy comprising:

a tethering means made entirely of a flexible material and forming a simple closed loop, and three handles, each of said handles having a grip section, an eyelet through which said tethering means passes so said eyelet is slideable along the entirety of said tethering means, and a swivel connecting said eyelet to said grip section and allowing said eyelet to rotate relative to said grip section, said grips sections being substantially larger and more massive than said eyelets, and said grip sections having centers of mass offset from said eyelets.

2. The toy of claim 1 wherein for each of said three handles said grip section is rotateable relative to said eyelet about an axis which passes through a center of said grip section and a center of said eyelet.

3. The toy of claim 1 wherein each of said eyelets is torus-shaped.

4. The toy of claim 1 wherein each of said handles is of the same construction.

5. The toy of claim 1 wherein each of said eyelets is openable to allow access to the inside of said eyelets so said string can be removed from said eyelets and a new string can be substituted.

6. The toy of claim 1 further including a pivot between each of said eyelets and each of the associated said grip sections.

7. The toy of claim 6 wherein said pivots allow orientations of said eyelets relative to the associated said grip sections to change.

8. The toy of claim 6 wherein said pivots are located between said grip sections and said swivels.

9. The toy of claim 1 further including a fourth handle having a fourth grip section, a fourth eyelet through which said tethering means passes, and a fourth swivel connecting said fourth eyelet to said fourth grip section and allowing said fourth eyelet to rotate relative to said fourth grip section, said fourth grip section being substantially larger and more massive than said fourth eyelet, and said fourth grip section having a center of mass offset from said fourth eyelet.

10. A toy comprising:

a sheet of flexible material, and three handles, each of said handles having a grip section and a swivel, each of said swivels having a grip end attached to said grip section and a sheet end attached to said sheet of flexible material, each of said swivels allowing an associated one of said grip sections to rotate relative to said sheet of flexible material, said grip sections being offset from said swivels and substantially larger and more massive than said swivels.

11. The toy of claim 10 wherein for each of said handles said grip section is rotateable relative to said sheet of flexible material about an axis which passes through a center of said grip section and a region where said sheet end of said swivel attaches to said sheet of flexible material.

12. The toy of claim 10 wherein each of said handles is of the same construction.

13. The toy of claim 10 wherein said sheet of flexible material is triangular and said handles are attached to said sheet of flexible material near corners of said sheet of flexible material.

14. The toy of claim 10 further including a fourth handle having a fourth grip section and a fourth swivel, said fourth swivel having a fourth grip end attached to said fourth grip section and a fourth sheet end attached to said sheet of flexible material, said fourth swivel allowing said fourth grip section to rotate relative to said sheet of flexible material, said fourth grip section being offset from said fourth swivel and substantially larger and more massive than said fourth swivel.

* * * * *